United States Patent [19]

Hunter

[11] Patent Number: 4,991,729

[45] Date of Patent: Feb. 12, 1991

[54] ELDER-ACCESSIBLE CHILD-RESISTANT PACKAGING

[76] Inventor: Robert M. Hunter, 320 S. Willson Ave., Bozeman, Mont. 59715

[21] Appl. No.: 339,819

[22] Filed: Apr. 18, 1989

[51] Int. Cl.[5] ..... B65D 50/10; B65D 50/06

[52] U.S. Cl. ..... 215/206; 215/208; 215/216

[58] Field of Search ..... 215/206, 202, 208, 211, 215/223, 230, 329, 332, 334, 216; 220/293, 297, 298

[56] References Cited

U.S. PATENT DOCUMENTS

| | | | |
|---|---|---|---|
| 2,722,328 | 11/1955 | Bell | 215/98 |
| 2,947,431 | 8/1960 | Haynes | 215/208 |
| 3,033,406 | 5/1962 | Sauber | 215/9 |
| 3,129,834 | 4/1964 | Kimball | 215/9 |
| 3,407,954 | 10/1968 | Millis | 215/9 |
| 3,450,290 | 7/1969 | Turner | 215/9 |
| 3,472,410 | 10/1969 | Turner | 215/206 |
| 3,516,563 | 6/1970 | Durso et al. | 215/221 |
| 3,587,896 | 6/1971 | Graff | 215/206 |
| 3,604,582 | 9/1971 | Boudin | 215/9 |
| 3,656,646 | 4/1972 | Taylor | 215/206 |
| 3,656,647 | 4/1972 | Swinn | 215/206 X |
| 3,703,974 | 11/1972 | Boxer et al. | 215/9 |
| 3,715,063 | 2/1973 | Susoki et al. | 215/329 X |
| 3,756,444 | 9/1973 | McIntosh | 215/220 |
| 3,773,204 | 11/1973 | Stroud | 215/9 |
| 3,782,574 | 1/1974 | Rumble | 215/9 |
| 3,878,961 | 4/1975 | Curry et al. | 215/219 |
| 4,020,965 | 5/1977 | Northup | 215/220 X |
| 4,053,078 | 10/1977 | Herr | 215/211 X |
| 4,071,156 | 1/1978 | Lowe | 215/206 X |
| 4,238,033 | 12/1980 | Artzt | 206/534 |
| 4,385,705 | 5/1983 | Kusz | 215/220 |
| 4,433,790 | 2/1984 | Gibson | 215/206 X |
| 4,456,139 | 6/1984 | Kent | 215/230 X |
| 4,469,233 | 9/1984 | Wegscheid | 215/230 |
| 4,520,938 | 6/1985 | Finke | 215/220 |
| 4,605,135 | 8/1986 | Ryder | 215/211 X |
| 4,782,963 | 11/1988 | Hunter | 215/206 |

FOREIGN PATENT DOCUMENTS

| | | | |
|---|---|---|---|
| 2618129 | 1/1989 | France | 215/329 |

*Primary Examiner*—Stephen Marcus

*Attorney, Agent, or Firm*—Dann, Dorfman, Herrell and Skillman

[57] ABSTRACT

A rotatable member is held within a closure cap by a circumferential ridge. Both the closure cap and the rotatable member carry inwardly projecting studs. Ribs on stepped cylindrical surfaces of the container neck are provided with channels that permit axial passage of the studs when properly aligned. Proper alignment is achieved by means of stops on the rotatable member and the closure cap which, when engaged during rotation, align the studs circumferentially with the channels. The rotatable member is provided with a frictional fit on the neck of the container, or the rib thereof, so that as the closure cap is rotated, the rotatable member will stay in position on the container neck until the stops contact one another. When the closure cap is rotated in a predetermined direction to a predetermined point, it will cause the stops to contact such as to properly index the studs on the rotatable member relative to channels in a rib on the container neck. Thereafter, rotating the closure cap in the opposite direction to a point which may be determined by markings on the container and the closure cap will cause the studs on the closure cap to be aligned with the channels in a second rib on the container neck so that the closure cap can be removed from the container.

36 Claims, 5 Drawing Sheets

ELDER-ACCESSIBLE CHILD-RESISTANT PACKAGING

This application discloses improvements that were discovered during research funded by the United States Department of Health and Human Service—National Institute of Child Health and Human Development (NICHD) under the Small Business Innovative Research Program. This invention was made with Government support under Grant No. 1 R43 HD24009-01 awarded by the National Institutes of Health. The Government has certain rights in the invention. The invention is described in detail in a report entitled "Cognitive Skill Based Child-Resistant Medicine Container" prepared for the NICHD by Yellowstone Environmental Science, Bozeman, Mont., January, 1989.

The present invention relates to structures providing elder-accessible child-resistant packaging combinations. In particular the present invention relates to a structure which enables adults to perform a simple combination of moves to either remove a cap or otherwise gain access to container contents. Without understanding the pattern, a child will find it difficult to open the closure. More specifically, the present invention provides cap and container components which can be easily manipulated by simple movements into a position in which the cap and container may be separated.

THE STATE OF THE ART

Currently available child-resistant closures may be relatively simple to operate in some cases, but very often require a certain amount of manual dexterity or even strength in one's fingers in order to perform the manipulative step or steps. Commonly such arrangements require rotation of a cap relative to a container and then application of force of some type in a designated place to remove the cap. In some structures of this type even the rotation can be difficult because the structures are not easily rotated. However, in most instances the problem comes with having to use fingers in a way particularly awkward or difficult for older people, or people with some sort of manual disability.

In the inventor's prior U.S. Pat. No. 4,782,963, a very effective child-resistant container and closure was developed. This structure is relatively easy for an adult to learn to use and requires little manipulative skill to operate, but it involves two movable members and would be more expensive to manufacture than available devices which are difficult to use.

THE NATURE OF THE PRESENT INVENTION

The present invention provides a closure which is easier for older people or people with physical disability to open but which is also inexpensive and child resistant. It is sufficiently simple and inexpensive to make commercialization an economic possibility.

In its broadest sense, the invention is a closure having a combination lock mechanism having one accessible, directly manipulated movable part and one inaccessible, indirectly moved movable part. Both the directly manipulated movable part and the indirectly moved movable part have fastening means that enable the closure to be locked. Both movable parts are provided with means of interacting so that movement of the inaccessible movable part can be achieved by movement of the accessible movable part. The means of interacting may take the form of interfering stops or the form of frictional engagement. The best mode of the invention involves its application to child-resistant packaging.

In its broadest aspect the present invention provides a child-resistant container part and closure cap part, one part movably supporting a single movable member that is frictionally engaged by either part and engaged and moved by the other part relative to the frictionally engaged part to at least one indexed position so that relative movement of the parts in the opposite direction frictionally carries the movable member to a position that allows access to the contents solely by relative movement of the parts.

Preferably the container part provides an opening into the interior of the container and has fastening means. The closure cap part has fastening means cooperating with the container fastening means allowing the closure cap part to be fastenable over the opening of the container. Preferably also the intermediate movable member is supported on one of the parts in a location making it inaccessible to direct manual manipulation. Only one kind of movement of the closure cap part relative to the container part is used. First movement in one direction moves said movable member by means of said interfering stops against its frictional engagement to an indexed position relative to said other of the parts. Then movement of said closure cap part in the other direction relative to the container to a predetermined position allows access to be gained to the interior of said container part. Such access cannot occur in other positions of the parts and member.

The best mode involves the use of a single relatively rotatable member, either supported on the cap or on the neck of a container in a generally cylindrical coaxial relationship with cap and container. As used herein the closure cap and the cooperating container region are the major closure parts, and the rotatable member is rotatably supported on one of those parts. In the preferred embodiments the relatively rotatable member is loose on its supporting part and makes frictional contact with the other part so that in relative rotation between container and cap, the supporting part will normally turn with respect to the rotatable member but the rotatable member will not turn with respect to the other (non-supporting) part.

Preferred fastening means are similar to those in the earlier invention comprising a stud or studs on a cylindrical surface of one part which is normally barred from axial passage by a rib on an opposed cylindrical surface on the other part. The stud can pass through a channel (or in some embodiments one of a pluralty of channels) in the rib when the parts are rotated relative to one another to the position where the stud and channel are aligned in a path parallel to the axis (axial path). The rotatable member and its supporting part each carry a fastening means on a cylindrical surface and opposed cylindrical surfaces of the part not supporting the rotatable member carry the cooperating fastening means. In one specific embodiment, for example, a pair of studs, one on the closure cap and another on the relatively rotatable member supported on the closure cap, are designed to pass through axial channels in separate circumferential ribs on cylindrical faces on the container opposing those supporting the studs. In the embodiments illustrated, in placing the container and cap together each stud may pass through a channel in a circumferential rib on an opposing surface which, in other positions of the relatively rotatable parts, would block its passage. Once studs pass through the channels and positions of relatively rotatable members are changed, each stud is held in place in an axial direction by the rib whose channel that stud passed through, but is free to move in a rotational or circumferential direction.

Unlike the modes of the inventor's prior invention disclosed in the above noted patent, it is not necessary for some studs to pass through several aligned channels. Instead each stud passes through a single channel in a particular circumferential rib, which rib thereafter holds the stud from axial movement when the parts are rotated except in the specific position of connection to and removal from the closure cap. Of course, there can be embodiments in which a stud may pass through more than one channel.

Once the studs have passed through their channels, sufficient rotation of the closure cap relative to the container causes interaction of interfering stops on the relatively rotatable member and its supporting part, and rotation of the rotatable member relative to the non-supporting part, thus causing the studs to assume different rotational positions other than the ones which enable stud passage through the channels. Alternatively, the closure cap may be snapped onto the container neck in a random position thus causing initial nonalignment of the studs and channels. Therefore, to remove the closure cap, the single relatively rotatable member must be first repositioned into proper relative position with respect to its non-supporting member and then the closure cap must be repositioned into proper relative position with respect to the container.

In the preferred embodiment, relative rotation of the closure cap in a predetermined direction causes interaction of interfering stops on the relatively rotatable member and its supporting part and rotation of the rotatable member relative to the non-supporting part against the previously mentioned frictional force to an indexed position. Then upon relative rotation of the closure cap in the opposite direction, the interfering stops are disengaged and the closure cap reaches a second marked predetermined relative position in which not only are the studs and/or channels on the rotatable member and its supporting member positioned an angular spacing apart corresponding to the cooperating channels and/or studs on the other member (which does not support the rotatable member), but they are axially aligned so that the closure cap may be axially removed from the container.

It will be clear to those skilled in the art that studs and channels are interchangeable in their relative positions and it is immaterial whether the studs or the channels are repositionable relative to one or the other. Unlike the disclosed modes of the prior invention, studs and channels need not be axially aligned, although they may be. Also the relatively rotatable member, instead of being freely rotatable on its supporting part, may be in frictonal contact with that supporting part. However, if the part subject to friction is changed in this way, it is also necessary to change the interfering stops to be respectively on the rotatable member and the part not supporting the rotatable member to achieve the equivalent ultimate indexing effect.

More specifically, the present invention relates to a child-resistant container and closure cap comprising two parts. The container part has an opening through the neck and fastening means on the neck. The closure cap part conforms to the neck and has fastening means allowing the closure cap to be fastenable over the opening. One of said two parts has a single movable member supported on one of the parts so that it may be limited to only one kind of movement relative to that part. In other embodiments, a plurality of movements are possible, but in all embodiments only one kind of movement is effective in unlocking the closure. The movable member has fastening means engageable with fastening means on the other part. An interfering stop on one part is engageable by an interfering stop on the movable member when the interfering stops are engaged by relative movement of the parts in a particular direction to define an indexed position of the one part and movable member. The part which does not have a stop has slippable frictional engagement with the movable member, causing the movable member to move with the part with which it is frictionally engaged until the stops are contacted. After the movable member is placed in the indexed position by the stops identified by a first set of marks on the respective parts, relative cap and container movement in the opposite direction to a predetermined position identified by a second set of marks on the respective parts allows release of the fastening means and separation of the cap and closure by relative axial movement of the closure cap and container The separation cannot occur in other positions of the closure cap and container.

DRAWINGS SHOWING PREFERRED EMBODIMENTS OF THE INVENTION

Figure 1:
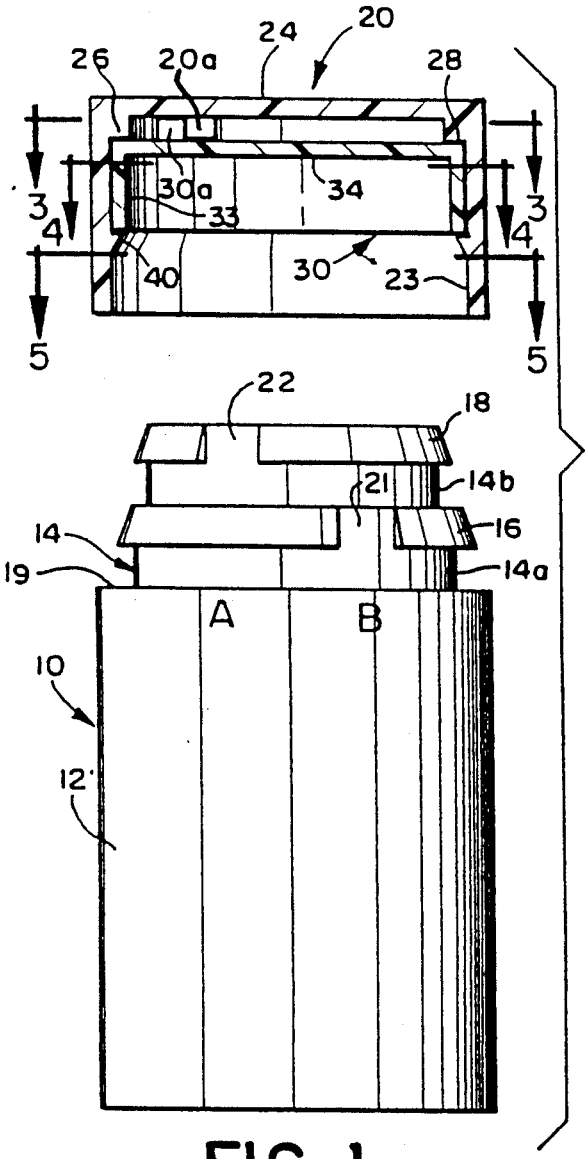
FIG. 1 is a side elevational view of a container and a closure cap supporting a relatively rotatable member according to the present invention with the closure cap removed and spaced from the container, shown in section.
Figure 10:
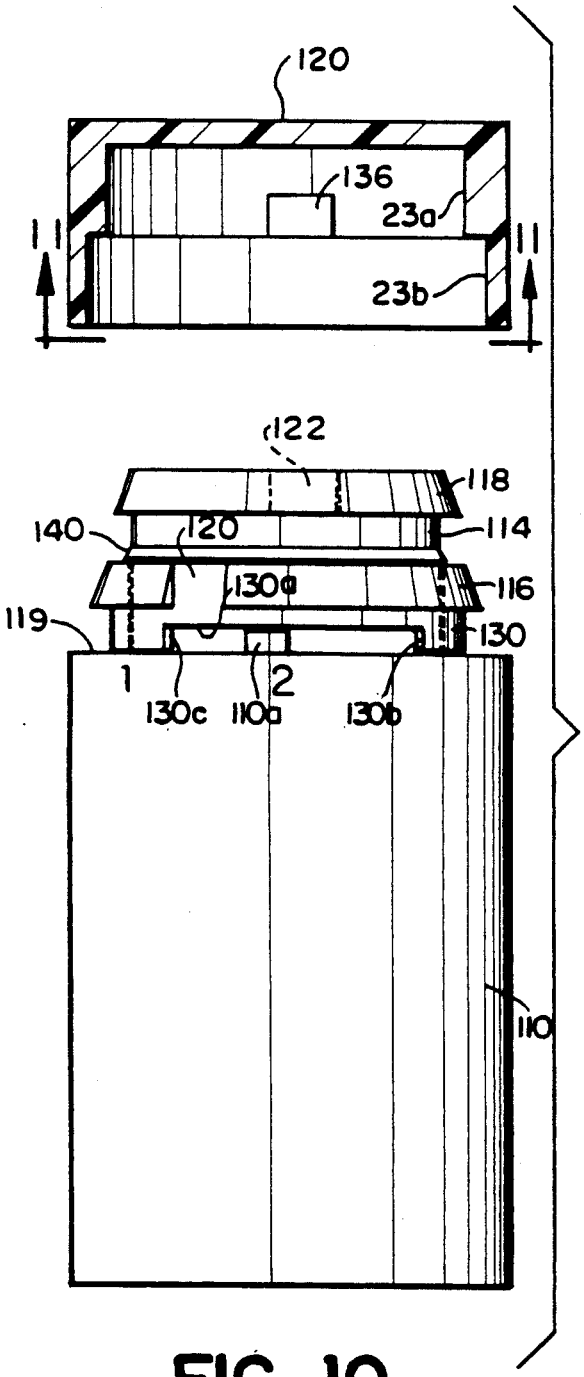
Figure 11:
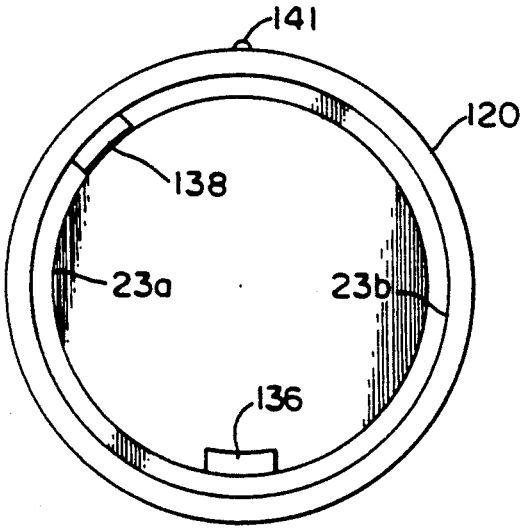

FIGS. 6*a* through 6*d* are diagrammatic showings of different versions of one geometrical form of the present invention typified by FIGS. 1-5;

FIGS. 7*a* through 7*d* are diagrammatic showings of different versions of another geometrical form of the present invention with a rotatable member supported by the closure cap;

FIGS. 8*a* through 8*d* are diagrammatic showings of different versions of still another geometrical form of the present invention with a rotatable member supported by the closure cap;

FIGS. 9*a* through 9*d* are diagrammatic showings of different versions of yet another geometrical form of the present invention with a rotatable member supported by the closure cap;

FIG. 10 is a view similar to FIG. 1 showing a variation in which the relatively rotatable member is supported on the neck of the container rather than on the closure cap, and FIG. 11 is a sectional view of FIG. 10 taken along line 11-11.

DETAILED DESCRIPTION OF THE DRAWINGS

Referring first to FIG. 1, there is illustrated a container, generally designated 10, for example, a pill bottle. The body portion of the container may be blow molded or otherwise conventionally fabricated of moldable resinous material and may be of any shape and dimensions provided it is terminated in a neck 14 of cylindrical form, through which is provided an open mouth access to the body 12 of the container 10. In this embodiment the neck is stepped from a larger diameter portion 14*a* to a smaller diameter portion 14*b* at the mouth opening. On the outer surface of the neck are molded or otherwise provided fastening means in the form of circumferential ribs 16 and 18 which are preferably arranged near the top of the respective cylindrical section. Each of the ribs 16,18 is provided with a discontinuity or channel 21,22 of sufficient width to permit passage of a stud, a cooperating fastening means as described below. Although they may vary in specific geometry and axial length, as well as cross-sectional shape, a preferred cross section shape for the ribs is triangular or beveled increasing in thickness in the direction away from the mouth. In some versions such a form permits the studs of the cap to be snapped over the ribs as the closure cap is placed onto the container.

Considering now the closure cap 20, the structure includes sidewalls 23 and closing end wall or top 24. The sidewalls provide a generally cylindrical internal surface whose diameter is considerably larger than the larger diameter portion 14*a* of the neck 14 of the container. In this particular embodiment the sidewalls 23 are thickened in the region 26 adjacent the end wall 24 to provide a shoulder 28 which acts as a spacer bearing for a nested rotatable member 30, also of cap form in this embodiment, rotatable relative to the closure cap 20. Shoulder 28 spaces rotatable member 30 at least a sufficient distance axially from the end wall 24 to accommodate interfering stops 20*a* and 30*a*. Stop 20*a* extends down from the top 24 of closure cap 20 and radially inward from the thickened wall region 26 and stop 30*a* extends up from the top 34 of rotatable member 30 inset from the edge so as to clear wall region 26 yet make contact with stop 20*a*. Single stops 20*a* and 30*a* on closure cap 20 and rotatable member 30 permit a large part of a full rotation of the rotatable member 30 relative to closure cap 20. At least one inwardly projecting stud 38 is provided on the inner cylindrical surface of sidewall 23 of closure cap 20. Similarly at least one inwardly projecting stud 36 is provided on inner wall 33 of rotatable member 30. The studs are of a width to pass through channels 21 and 22, respectively, and are so positioned on walls 23 and 33 as to lie below ribs 18 and 16 when the top 34 of rotatable member 30 is in place over the neck of the container. Although they may vary in specific geometry and axial length, as well as cross-sectional shape, a preferred cross section shape for the studs 36 and 38 is triangular or beveled increasing in thickness in the direction toward the tops 34 and 24. In some versions such a form permits the studs to be snapped over the ribs as the closure cap is placed onto the container. In order to be able to insert the container neck into the cap the studs may be properly indexed relative to one another, which occurs when the closure cap 20 is rotated relative to the rotatable member 30 to a predetermined position. In this position the angular circumferential spacing between the studs 36 and 38 corresponds to that of channels 21 and 22 so that when the studs are aligned with the channels on the neck the studs can pass through the channels and allow axial movement of the cap 20 onto the container to close the container. Then when the closure cap is turned relative to the container sufficiently for stops 20*a* and 30*a* to interact and turn the rotatable member relative to the container, the studs will underlie the respective ribs 18 and 16 keeping the closure cap in place.

In practice the rotatable member 30 is loosely held in the closure cap 20 by a small retainer ring 40 past which the rotatable member is forced in assembly. The loose fit is designed into the structure just as a snug fit is designed between part of the sidewalls 33 of the rotatable member 30 and neck 14*b*, or more precisely rib 18 is. The sidewalls 33 of the rotatable member 30 may be tapered or flared out very slightly so that clearance decreases between the rib 18 and the sidewalls 33 of rotatable member 30 as the closure cap 20 is moved into place so that some part of the neck portion 14*b*, here rib 18, frictionally engages the sidewalls 33. Alternatively, sidewalls 33 may be designed to deform in shape and/or circumferential length to provide a snap fit. Other methods of accomplishing such a frictional engagement are disclosed in the inventor's above-referenced patent. This has the effect of better closing the container as well as causing the relatively rotatable member 30 not to rotate with the closure cap but to stay with the body 12 of container 10 during relative rotation until the stops 20*a* and 30*a* make contact. At that point the closure cap 20 will drive the rotatable member 30 by means of the stops and against the frictional force.

Figure 3:
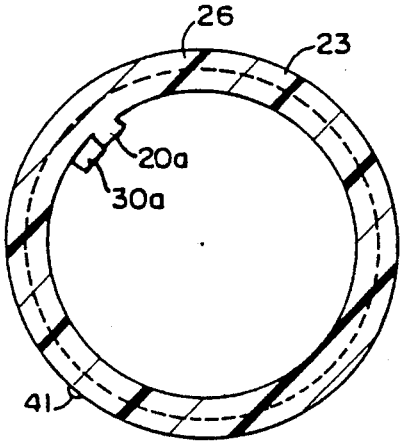
FIG. 3 is a sectional view taken along line 3—3 of FIG. 1.
Figure 4:
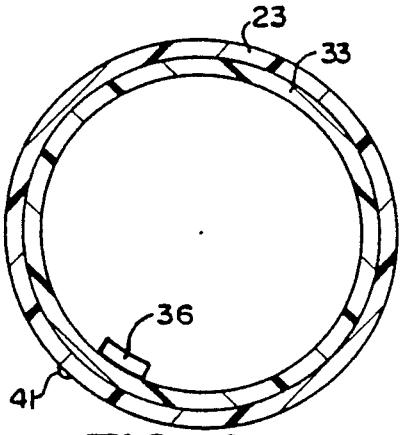
FIG. 4 is a sectional view taken along line 4—4 of FIG. 1.
Figure 5:
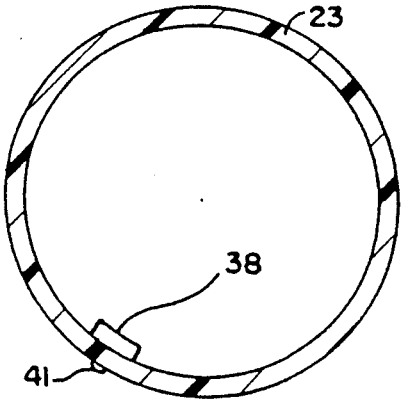
FIG. 5 is a sectional view taken along line 5—5 of FIG. 1.
Figure 2:
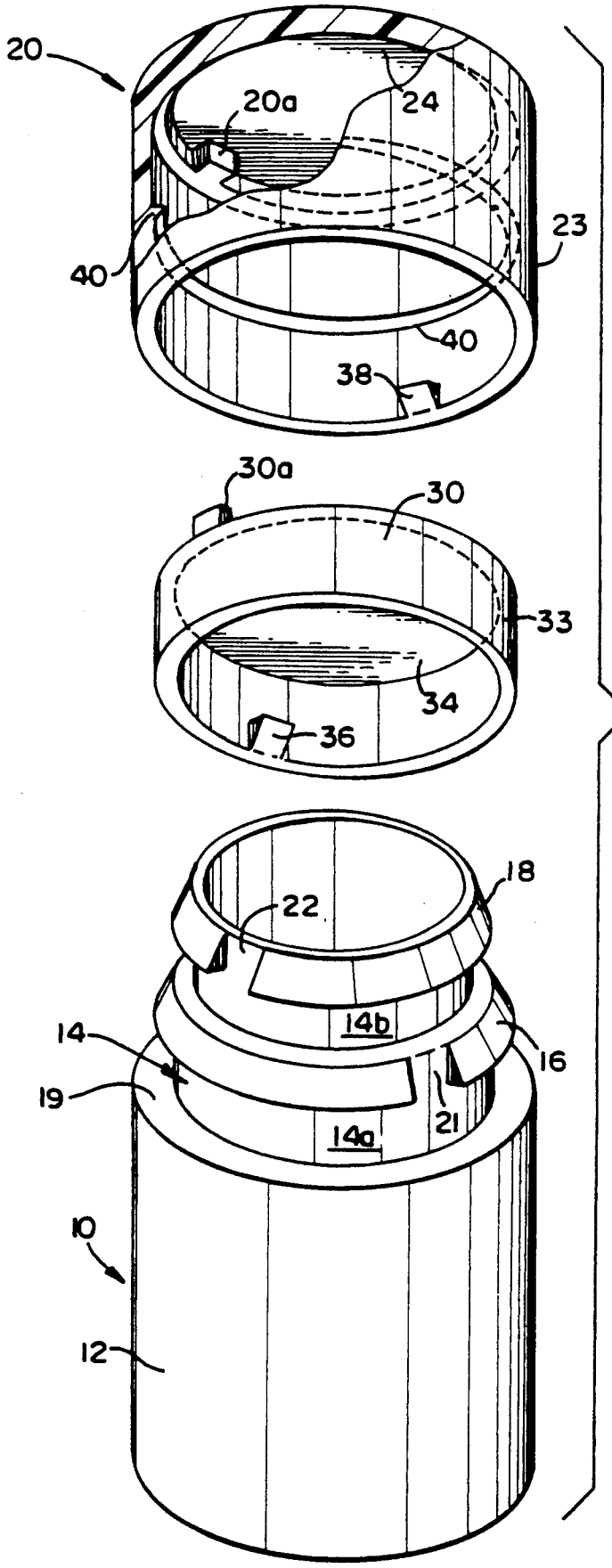
FIG. 2 is an exploded perspective view of the container and closure cap of FIG. 1 showing the rotatable member separated from the closure cap structure.

For a better understanding of the cooperation between the rotatable member 30 and the closure cap 20 reference is made to FIGS. 3, 4 and 5, as well as FIGS. 1 and 2. FIG. 2 shows the closure cap structure in an exploded view with part of the closure cap broken away so that structure of closure cap 20 and relatively rotatable member 30 can be seen in greater structural detail. In FIG. 2, the perspective in the container is looking down, whereas the perspective on the cap and rotatable members is looking up. As seen in FIG. 2, this particular embodiment of the invention employs a single stud 36 on sidewalls 33. Closure cap 30 carries a similar single stud 38 circumferentially offset from stud 36 when the closure is in the open or unlocked position.

In other variations of this embodiment there can be multiple studs, for example, corresponding to each stud cooperating with channels correspondingly spaced on the neck. A single stud can, of course, also be used with a plurality of channels to provide multiple opening positions should that be desired. Alternatively, a plurality of studs may be provided only one of which is small enough to pass through a channel so that at least one stud must be resiliently snapped over the rib in placing the closure cap on the neck. Closure removal then is accomplished matching at least one stud with a channel and rocking the cap to snap at least one other stud past the rib or, alternatively, by snapping all of the other studs past the rib.

In most embodiments a stud need not be of great length, but its width must be dimensioned to pass through channels 21 or 22. The upper surface 34 of rotatable member 30 abuts bearing shoulder 28 on closure cap 20. The shoulder 28 positions and in assembly limits the inward movement of the rotatable member 30. In other arrangements circumferentially spaced posts on either closure cap or rotatable member could serve the same purpose as axial stops.

Assuming that the closure cap is on the container and one wishes to remove it, it is convenient to provide markings on the container and closure cap to enable realignment of the studs and channels. The markings may be printed in contrasting color using a relatively large typeface such as Helvetica 12 point. Alternatively, they may also be raised or embossed and/or printed with a phosphorescent ink to allow their recognition and use in the dark. Here they are shown on FIGS. 1–5 as the black letters A and B on the white container 10 and an embossed black line or arrow 41 on the closure cap 20. First the closure cap is rotated a full rotation counterclockwise to achieve indexing contact between stops 20*a* and 30*a*, rotating rotatable member and stopping the arrow at the letter A. This aligns stud 36 with channel 22 which is the illustrated condition. Then rotation in the opposite direction to position B will position stud 38 to pass axially through channel 21. In this embodiment, the embossed black line, or arrow 41 and the black letter A comprise a first set of marks and the embossed black line or arrow 41 and the black letter B comprise a second set of marks.

FIG. 1 shows rotatable member 30 held in closure cap 20 by retainer ring 40 such that relative axial movement of rotatable member 30 in closure cap 20 is prevented. Similarly, the axial dimensions of the closure cap sidewalls and container neck, as well as the locations of stud 38 and rib 16 are such that axial movement of closure cap 20 is effectively prevented when the closure is in the locked condition. Thus only one type of relative movement, rotation, both of the rotatable member 30 and closure cap 20 relative to container 10 is possible when the closure is locked.

In an alternative embodiment (not shown), the sidewalls 23 of closure cap 20 are axially longer by a length slightly more than the axial heights of studs 20*a* and 30*a*. The retainer ring 40 and stud 38 are located an additional axial distance (slightly longer than the axial heights of stops 20*a* and 30*a*) from shoulder 28. With this design, upward force on closure cap 20 during an attempt at unlocking moves closure cap 20 axially away from container 10 and rotatable member 30 by an axial distance slightly greater than the axial heights of stops 20*a* and 30*a*. In this position, rotation of closure cap 20 does not cause stops 20*a* and 30*a* to engage, thus indirect movement of rotatable member 30 is not possible. In fact, indirect movement of rotatable member 30 is possible only if closure cap 20 is gently pressed axially toward container 10 during the unlocking procedure. Thus, this design allows upward movement of closure cap 20 when the closure is locked and causes disengagement of the interfering stops 20*a* and 30*a* when a simultaneously pulling and turning strategy is used to attempt to unlock the closure. The design allows two types of motion of the closure cap relative to the container (i.e., limited axial motion and rotation) when the closure is locked, but only one type of motion (i.e., rotation) is effective in unlocking the closure.

In all of the embodiments disclosed herein, the length of sidewalls 23 is sufficient to ensure that sidewalls 23 essentially abut shoulder 19 at the base of the neck 14 when the closure is locked. This design feature prevents unlocking by a child using a simultaneous pushing (or tilting) and turning strategy, but allows unlocking when only one type of motion (i.e., rotation) is used.

Although the embodiments described above are provided with a single stud on the closure cap and a single stud on the rotatable member, a plurality of studs could be provided on each. If a plurality of studs (for example, three) and only a single channel in each rib are provided, then at least one of the studs on both the closure cap and the rotatable member must be sized to permit passage through the appropriate channel. Alternatively, all of the studs may be so sized. Of course, the closure cap and rotatable part may be provided with different numbers of studs or channels.

If three studs and three channels are provided, the studs and channels may be located at circumferential positions such that no two studs are aligned with channels unless each stud is aligned with a channel. With three studs and three channels, this can be accomplished by separating both the studs and channels by 85, 120 and 155 degrees.

Referring now to the schematic diagrams FIGS. 6*a* through 6*d*, 7*a* through 7*d*, 8*a* through 8*d* and 9*a* through 9*d*, these diagrams schematically represent a large selection of embodiments having the movable member supported by the closure cap. Those diagrams with a common figure number represent a type of geometry. The letter suffixes show various possible stud and rib (channel) positions. All of these drawings represent variations on the structure of FIGS. 1–5 wherein rotatable member 30 is carried within the closure cap 20 held in place by a retaining ring 40 here shown as a rectangle. In each of the figures, the circumferential ribs 16 and 18 are each represented by a semi-circle and the studs 36 and 38 are represented by a triangle. It will be understood that the locations of the triangles and the semi-circles are simply to show relative axial positioning and have nothing to do with actual circumferential positions of the studs or channels in the ribs.

Figure 6A:
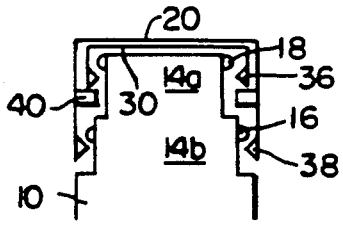

Referring first to FIGS. 6*a* through 6*d*, the structures diagramed are like that of FIGS. 1–5 in that the rotatable member is a cap itself. In fact, FIG. 6*a* is the schematic representation of FIGS. 1–5 so that correlation of the symbols can more easily be understood by a comparison of the first figure. In each of these constructions, the neck of the container is comprised of a stepped cylindrical surface wherein the surface closest to the mouth is smaller in diameter and in this first group, the smaller diameter neck portion cooperates with the rotatable member 30. It will be understood that the same numbers are used throughout these schematic figures to designate corresponding parts even though FIGS. 7, 8 and 9 differ in geometry to those of FIGS. 1–6.

As previously pointed out in FIG. 6*a*, the upper narrower neck of the container carries circumferential rib 18 and the rotatable member carries stud 36 which must pass through the gap in rib 18. Lower larger cylindrical surface carries rib 16 and the actual closure cap itself carries stud 38.

Figure 6B:
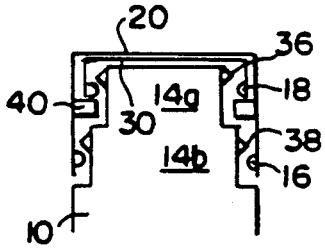

In FIG. 6*b*, studs and the rings are interchanged on their support structures, that is, studs are now on the two diameters of the neck of container 10, rib 16 is on the closure cap 20 itself and rib 18 on the rotatable member 30.

Figure 6C:
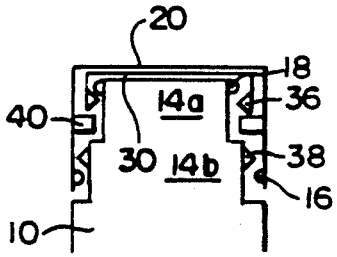

In FIG. 6*c*, a hybrid situation is presented in which rib 18 is on the small diameter portion 14*a* of the neck and stud 36 on the rotatable member 30. The larger diameter portion 14*b* carries stud 38 rib 16 and the closure cap 20 carries rib 16.

Figure 6D:
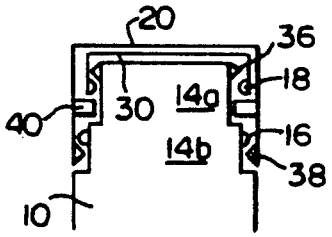

This situation is reversed in FIG. 6*d* wherein the smaller diameter neck portion carries stud 36 and the larger diameter portion carries rib 16. Closure cap 20 carries stud 38 and the relatively rotatable member 30 carries rib 18.

FIGS. 7*a*–7*d* have in common another geometry in which the modified type of inner rotatable member instead of having the skirt of rotatable member 30 over the outside of the neck portion, has a skirt inside of the neck portion. Since there are then the outer cylindrical surface of rotatable member 30 confronting the inner cylindrical surface of a one diameter neck, the outer cylindrical surface of the neck confronts the inner surface of the closure cap 20.

Figure 7A:
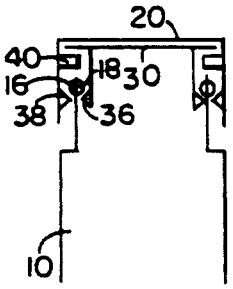

In FIG. 7*a*, rib 16 is provided on the outside surface of the neck and rib 18 on the inside surface. Therefore, stud 38 is placed on the inside surface of the closure cap 20 and stud 36 on the outside surface of the cap skirt of the rotatable member 30 to fall below their respective ribs.

Figure 7B:
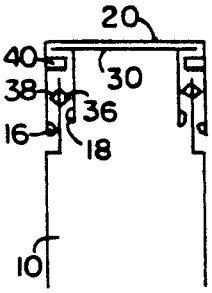

In FIG. 7*b*, the situation is reversed, namely: rib 16 is on the inside surface of the skirt of closure cap 20 and rib 18 on the outside surface of the skirt of the rotatable member 30. Studs 38 and 36 are then placed on the outside and inside surfaces of the neck, respectively. It will be understood in FIGS. 7*a* and 7*b* that the studs do not have to be placed at the same level, and the position of the ribs, of course, will be coordinated with the position of the studs, and vice versa.

Figure 7C:
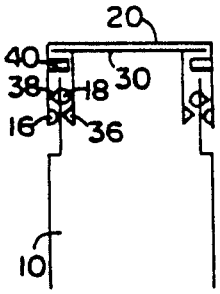

In FIG. 7*c*, rib 16 is placed on the inside of the skirt of closure cap 20, stud 38 on the outside of the neck, rib 18 on the inside of the neck and stud 36 on the outside of the skirt of rotatable part 30.

Figure 7D:
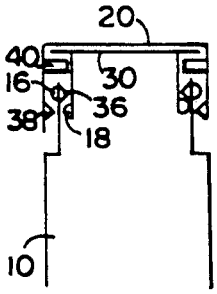

In FIG. 7*d*, the structure is again modified so that stud 38 is on the inside surface of the closure cap 20. Therefore, rib 16 is on the outside surface of the neck. Stud 36 is on the inside surface of the neck and rib 18 is, therefore, on the outside surface of the skirt of rotatable member 30.

FIGS. 8*a*–8*d* represent still another geometrical form of rotatable member 30 wherein simply a rotatable member 30 which is a ring is employed. It will be understood that a modified rotation-limiting stop arrangement may have to be employed. Again, in this construction, a stepped diameter neck is employed.

Figure 8A:
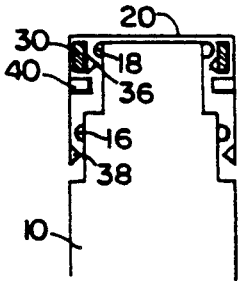

In FIG. 8*a*, rotatable member 30 carries stud 36 which is cooperative with rib 18 on the smaller diameter portion of the neck. Rib 16 is placed on the outer diameter of the larger portion of the neck and stud 38 on the inner surface of closure cap 20.

Figure 8B:
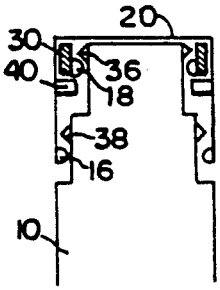

In FIG. 8*b*, rotatable member 30 carries rib 18 and the smaller diameter of the neck carries stud 36. The skirt of closure cap 20 carries rib 16 and the larger diameter neck portion stud 38.

Figure 8C:
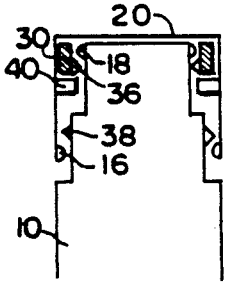

In FIG. 8*c*, the rotatable member 30 carries stud 36 which cooperates with rib 18 on the smaller diameter portion of the neck. Rib 16 on the skirt of the closure cap 20 cooperates with the stud 38 on the larger portion of the neck.

Figure 8D:
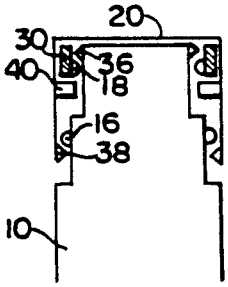

In FIG. 8*d*, the rotatable member 30 carries rib 18 which is opposed on the smaller diameter portion of the neck by stud 36. The inner diameter of closure cap 20 carries stud 38 which is opposed on the larger diameter portion of the neck by rib 16.

FIGS. 9*a*–9*d* illustrate another variation, somewhat like FIGS. 7*a*–7*d* in that the rotatable member 30 lies at least partially inside the neck of container 10. The rotatable member 30 is shown as a tubular member having an outward extending flange retained by retainer ring 40.

Figure 9A:
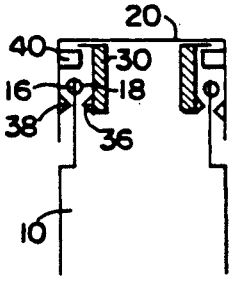

In the FIG. 9*a* version, rotatable member 30 carries a stud 36 which cooperates with rib 18 on the inner surface of the neck. This inner surface of closure cap 20 carries stud 38 which cooperates with rib 16 on the outer surface of the neck.

Figure 9B:
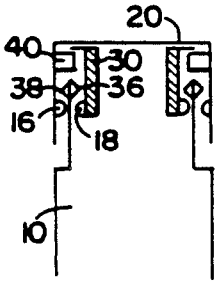

FIG. 9*b* shows the opposite version wherein rotatable member 30 carries rib 18 which cooperates with stud 36 on the interior surface of the neck. Closure cap 20 carries rib 16 which cooperates with stud 38 on the outer surface of the neck.

Figure 9C:
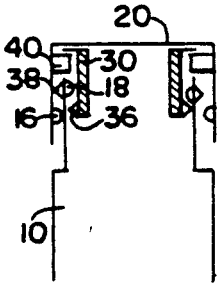

FIG. 9*c* shows a variation in which rotatable member 30 carries stud 36 which cooperates with rib 18 on the inner surface of the neck, whereas stud 38 is on the outer surface of the neck and cooperates with rib 16 on the inner surface of the closure cap 20.

Figure 9D:
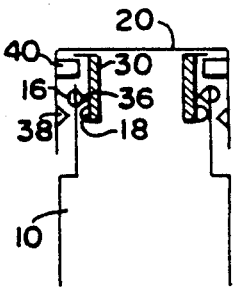

FIG. 9*d* illustrates the structure in which rotatable member 30 carries rib 18 on the outer surface opposed to stud 36 on the inner surface of the neck. Rib 16 is on the outer surface of the neck opposed to stud 38 on the inner surface of closure cap 20.

It will be understood by those skilled in the art that all variations shown operate in essentially the same way, namely: the interfering indexing shoulder on closure cap 20 abuts the indexing shoulder on the rotatable member 30 to space the fastening means. Rotation of the closure cap relative to the container drives the rotatable member to a position in which the studs can pass through the channels in the respective opposing rib. The closure cap is rotated in the opposite direction to align the studs and channels associated with it to permit relative axial movement of the closure cap and container.

Referring now to FIGS. 10 and 11, a structure of similar sort is shown wherein corresponding parts have corresponding numbers but with the prefix 100. Thus, the container is 110, the closure cap 120 and the rotatable member 130. In this case, however, the rotatable member 130 is supported on the container and rotates freely relative to that member rather than on the closure cap as in the embodiments shown and described hereinbefore. In this version, rib 116 is supported on rotatable member 130, whereas rib 118 is supported on neck 114 of the container 110. Rotatable member 130 is preferably snapped over rib 118 and then over retainer ring 140 during manufacture. Rotatable member 130 is preferably provided with a friction fit with closure cap 120 so that it rotates with the closure cap relative to the container or, if the container is rotated it stays stationary with the closure cap. In this embodiment, the stop 110*a* on the container 110 confronts either shoulder 130*b* or 130*c* in slot 130*a* in the bottom edge of rotatable member 130 as the opposing interfering stop. By rotating closure cap 120 clockwise, thus engaging the stop 110*a* with the indexing one of the shoulder stops 130*b*, and continuing to rotate the closure cap 120 clockwise until embossed line 141 is aligned with numeral 1, the channel 120 may be put in proper relative position corresponding to the circumferential spacing of stud 138 on the closure cap 120. Then all that is necessary is to rotate the closure cap in the opposite direction to a position indicated by alignment of line 141 with numeral 2 where stud 136 is aligned with channel 122 to permit axial movement.

It will be clear to those skilled in the art the equivalent variations shown in FIGS. 6*a*–6*d*, 7*a*–7*d*, 8*a*–8*d* and 9*a*–9*d* can be employed with the FIG. 10 construction.

Likewise, the friction may be applied alternatively between the rotatable member and the container in which case the indexing stops will have to be supplied on the rotatable member and the closure cap.

Many variations of the invention will occur to those skilled in the art. All such variations within the scope of the claims are intended to be within the scope and spirit of the invention.

I claim:

1. A child-resistant container and closure cap combination comprising two parts:

a container part and a closure cap part;

one of the two parts movably supporting a single movable member that is frictionally engaged by a selected part, the movable member being engaged and moved relative to the frictionally engaged part by means on the other part to at least one indexed position relative to the selected part so that movement of the parts in the opposite direction frictionally carries the movable member relative to the other part to a position relative to the other part that allows access to the container contents solely by relative movement of the two parts.

2. The container and closure cap of claim 1 in which the movable member is inaccessible to manual manipulation.

3. The container and closure cap of claim 2 in which the movable member is rotatable and located coaxially between container and closure cap.

4. The container and closure cap of claim 3 in which a cylindrical surface is provided on said container and an opposing cylindrical surface is provided on said closure cap, a cylindrical surface is provided on said movable member and an opposing cylindrical surface is provided on the part not supporting but frictionally engaging the movable member, and cooperating fastening means are respectively provided on opposed cylindrical surfaces of the container and closure cap and on opposed cylindrical surfaces of the movable member and the part not supporting, but frictionally engaging the movable member.

5. The container and closure cap of claim 4 in which the fastening means on one surface of each of the opposed cylindrical surfaces is a structure selected from the group consisting of at least one stud and one circumferential rib having at least one channel interrupting the rib, and the fastening means on the two opposing cylindrical surfaces is the other structure in said group.

6. The container and closure cap of claim 5 in which some flexibility is provided in at least a portion of the cylindrical surfaces having at least one stud and the at least one stud provides a tapered surface increasing in thickness in the direction toward the top of the closure cap so as to permit the at least one stud to pass over the rib in putting the closure in place in consequence of the flexibility but to present a shoulder to the rib to prevent axial removal of the closure cap once in place.

7. A child-resistant container and closure comprising:

a container part providing an opening into the interior of the container and having fastening means;

a closure part having fastening means allowing the closure part to be fastenable over the opening of the container; and an intermediate movable member supported on one of the parts and having fastening means engagable by fastening means on the other of the parts, said movable member having an interfering stop engagable by an interfering stop on either one of the parts and a slippable frictional engagement with the other of the parts;

wherein only one kind of movement of the closure part relative to the container part is used to move said movable member by means of said interfering stops against its frictional engagement to an indexed position relative to said other of the parts and then to move said closure part in the other direction relative to the container part to a predetermined position that allows access to be gained to the interior of said container, which access cannot occur in other positions of the parts and member.

8. The container and closure of claim 7 wherein said fastening means are unthreaded.

9. The container and closure of claim 7 in which the intermediate movable member is in a location making it inaccessible to direct manual manipulation.

10. The container and closure cap of claim 9 in which the closure is a cap and the intermediate movable member is a rotatable member coaxially supported to lie between the container and cap.

11. A child-resistant container and closure cap comprising two parts:

a container having an opening through a neck and fastening means on the neck; and a closure cap conforming to said neck having fastening means allowing the closure cap to be fastenable over the opening;

one of said two parts having a single movable member supported on one of the parts so that the movable member is limited to only one kind of effective movement relative to the other part said single movable member having fastening means engageable with the other part; and an interfering stop on one part engagable by an interfering stop on the movable member, the part which does not have a stop having a slippable frictional engagement with the movable member causing the movable member to move with the frictionally engaged part unless the stops are contacted, such that, when the stops are in contact during relative rotation of the container and closure cap in a designated direction the movable member is moved by the stops relative to the part with which it has frictional engagement to a designated indexed position identified by a first set of marks on the respective parts, following which relative closure cap and container movement in the opposite direction to another designated position, identified by a second set of marks on the respective parts, allows separation of the closure cap and container by relative axial linear movement thereof.

12. The container and closure cap of claim 11 in which separation can occur only in the position of the container and closure cap designated by aligning the second set of marks.

13. The container and closure cap of claim 12 in which the movable member is a rotatable member limited to a rotational movement about the axis of the closure cap and container.

14. The container and closure cap of claim 13 in which the rotatable member includes an annular surface making frictional contact with one part.

15. The container and closure cap of claim 14 in which the frictional engagement is between the rotatable member and the part which does not support the rotatable member whereas the stops are on the supporting part and the rotatable member.

16. The container and closure cap of claim 15 in which the rotatable member is supported on the closure cap.

17. The container and closure cap of claim 16 in which the rotatable member and its supporting closure cap each contain a fastening means on opposed conforming concentric surfaces and the container provides cooperating fastening means on concentric surfaces opposed to those on the rotatable member and closure cap.

18. The container and closure cap structure of claim 17 in which the rotatable member is retained within the closure cap by a retaining ring on the inside sidewall of the closure cap and provides a surface supporting fastening means of smaller diameter than that of the closure cap sidewall surface supporting fastening means so that the container neck provides opposed surfaces provided with appropriate cooperating fastening means at different diameters.

19. The container and closure cap structure of claim 18 in which the container neck has stepped cylindrical surfaces of decreasing diameter toward the mouth of the container, each provided with fastening means opposing somewhat larger diameter cylindrical surfaces on the closure cap and rotatable member, respectively, in closed position.

20. The container and closure cap structure of claim 18 in which the rotatable member is a cap.

21. The container and closure cap structure of claim 18 in which the rotatable member is a ring.

22. The container and closure cap structure of claim 15 in which the rotatable member is supported on the neck of the container.

23. The container and closure cap structure of claim 22 in which the rotatable member and the neck of its supporting container each contain a fastening means on a cylindrical surface and the closure cap provides cooperating fastening means on opposed concentric surfaces.

24. The container and closure cap structure of claim 23 in which the rotatable member is retained on the neck of the container by a retaining ring on the neck and provides a surface supporting fastening means of smaller diameter than that of the closure cap, the sidewall surface of the closure cap also supporting cooperating fastening means.

25. The container and closure cap structure of claim 24 in which the closure cap has stepped cylindrical surfaces of decreasing diameter towards the top of the closure cap, each provided with fastening means.

26. The container and closure cap structure of claim 18 in which the rotatable member is retained within the closure cap by a retaining ring on the inside sidewall of the closure cap and provided with a surface supporting fastening means of a smaller diameter than that of the container neck supporting fastening means to extend within the container neck and opposed to cooperating fastening means on the inside of the container neck.

27. The container and closure cap structure of claim 26 in which the container neck has fastening means on both the inside and the outside of the neck cooperable with the cooperating fastening means on the rotatable member and on the closure cap, respectively.

28. The container and closure cap structure of claim 27 in which the rotatable member has a cylindrical tubular portion bearing fastening means and a radially extending member supported within the closure cap and extending to the sidewalls of the closure cap so that it may be retained by the retaining means on the inside sidewalls of the closure cap.

29. The container and closure cap structure of claim 28 in which the tubular portion is closed off to provide a cap closure.

30. A child-resistant container and closure cap comprising two parts:

a container having an opening through a neck providing a cylindrical outer surface; and a closure cap having a cylindrical inner surface conforming to said neck and capable, in a certain relative rotational position, of axial movement between a closed container position and an open position;

a first circumferential rib supported on one of the cylindrical surfaces having at least one channel interrupting the rib and a first stud supported on and protruding from the other cylindrical surface, the first stud extending sufficiently close to the first rib supporting cylindrical surface that upon axial closure movement of the closure cap away from the container the stud cannot pass the rib except through the channel;

a single rotatable member supported on one of said two parts so that it is effectively limited to only coaxial rotational movement relative to that part and having a cylindrical surface opposite the cylindrical surface of the part different from that part supporting the first rib or stud in the closed container position;

a second stud supported on one of the different part of the opposed cylindrical surface of the rotatable member, protruding from that cylindrical surface toward the other and a second circumferential rib supported on the other cylindrical surface coacting with the second stud, the second stud extending sufficiently close to the second rib supporting surface that upon axial closure movement of the closure cap away from the container the second stud cannot pass the second rib except through a channel interrupting the second rib;

the channel of each of the first and second ribs being of sufficient width in the circumferential direction and sufficient depth in the radial direction to permit the passage of the coacting stud and the respective location of the stud and rib being such that each stud must have passed its respective rib to achieve the closed container position; and an interfering stop on one part engagable by an interfering stop on the rotatable member, the part which does not have a stop having a slippable frictional engagement with the movable member causing the rotatable member to rotate with the frictionally engaged part unless the stops are contacted, such that, when the stops are in contact during relative rotation of the container and closure cap in a designated direction, the rotatable member is moved by the stops relative to the part with which it has frictional engagement to a designated indexed position, identified by a first set of marks on the respective parts, following which relative closure cap and container movement in the opposite direction to another position identified by a second set of marks on the respective parts will allow passage of the first and second studs through the respective first and second rib channels and separation of the closure cap and container by relative axial linear movement of the closure cap and container.

31. The container and closure cap of claim 30 in which the rotatable member is supported on the closure cap.

32. The container and closure cap structure of claim 31 in which the rotatable member is retained within the closure cap by a retaining ring on the inside sidewall of the closure cap and the rotatable member provides a cylindrical surface of smaller diameter than that of the closure cap sidewall surface so that the container neck provides opposed surfaces of different diameters.

33. The container and closure cap structure of claim 32 in which the container neck has stepped cylindrical surfaces of decreasing diameter toward the mouth of the container opposing somewhat larger diameter cylindrical surfaces on the closure cap and rotatable means, respectively, in the closed position.

34. The container and closure cap structure of claim 31 in which the rotatable member is retained on the closure cap and provides a cylindrical surface of smaller diameter than the neck and extending within the neck in the closed position so that the outer cylindrical surface of the rotatable member extending within the neck and the inner cylindrical surface of the neck alternatively support the second rib and the second stud.

35. The container and closure cap structure of claim 30 in which the rotatable member is supported on the neck of the container.

36. The container and closure cap structure of claim 34 in which the rotatable member is retained on the neck of the container by a retaining ring on the neck and provides a surface supporting fastening means of smaller diameter than that of the closure cap, the sidewall surface of the closure cap also supporting cooperating fastening means.

* * * * *